US006299166B1

(12) United States Patent
Factor

(10) Patent No.: US 6,299,166 B1
(45) Date of Patent: Oct. 9, 2001

(54) METHOD AND APPARATUS FOR PLAYING A DICE GAME

(76) Inventor: Eduardo Factor, 1749 William Street, Vancouver, BC (CA), V5L 2R5

( * ) Notice: Subject to any disclaimer, the term of this patent is extended or adjusted under 35 U.S.C. 154(b) by 0 days.

(21) Appl. No.: 09/429,289

(22) Filed: Oct. 28, 1999

(51) Int. Cl.[7] ..... A63F 9/04

(52) U.S. Cl. ..... 273/146; 273/236; 273/268; 273/274

(58) Field of Search ..... 273/236, 274, 273/146, 268

(56) References Cited

U.S. PATENT DOCUMENTS

| | | | | |
|---|---|---|---|---|
| D. 401,867 | * | 12/1998 | Appelman | D10/46.1 |
| 882,945 | * | 3/1908 | Hurst | 273/146 |
| 1,527,937 | * | 2/1925 | Tienken | 273/274 |
| 2,546,347 | * | 3/1951 | Rengel | 273/134 |
| 4,421,315 | * | 12/1983 | Cutler | 273/268 |
| 4,469,329 | * | 9/1984 | Guyer | 273/146 |
| 4,648,602 | * | 3/1987 | Maroney | 273/146 |
| 4,811,954 | * | 3/1989 | Hemmann | 273/283 |
| 4,927,158 | * | 5/1990 | Lierman | 273/268 |
| 4,930,780 | * | 6/1990 | Goodman et al. | 273/146 |
| 5,350,175 | | 9/1994 | DiLullo et al. . | |
| 5,425,537 | | 6/1995 | Vogelsang . | |
| 5,456,467 | * | 10/1995 | Hoover | 273/146 |
| 5,476,265 | | 12/1995 | Miller et al. . | |
| 5,490,670 | | 2/1996 | Hobert . | |
| 5,513,850 | | 5/1996 | Vancura . | |
| 5,605,331 | * | 2/1997 | Boe | 273/146 |
| 5,649,704 | * | 7/1997 | Dobbin | 273/268 |
| 5,688,126 | * | 11/1997 | Merritt | 434/128 |
| 5,695,193 | * | 12/1997 | Cheung | 273/274 |
| 5,728,002 | | 3/1998 | Hobert . | |
| 5,746,428 | | 5/1998 | Fredenburg . | |
| 5,769,715 | * | 6/1998 | Brown | 463/10 |
| 5,788,239 | * | 8/1998 | Kong | 273/274 |
| 5,788,240 | | 8/1998 | Feinberg . | |
| 5,806,847 | * | 9/1998 | White et al. | 273/309 |
| 5,829,748 | * | 11/1998 | Moore, Jr. | 273/274 |
| 5,829,749 | | 11/1998 | Hobert . | |

* cited by examiner

*Primary Examiner*—Steven Wong
*Assistant Examiner*—Dolores R. Collins
(74) *Attorney, Agent, or Firm*—Robert H. Barrigar

(57) ABSTRACT

The game of Olé is a dice game played between at least two players using a pair of conventional six-sided dice. All possible combinations of the values of upturned faces of the pair of dice are exhaustively ranked. A session of play consists of a number of turns, wherein in each turn, each player rolls the pair of dice. The value of each player's rolled dice is ranked and a losing player is determined to be the player having rolled the worst-ranked combination. The losing player then deducts a point from a collection of points assigned to him at the start of the game. Turns are played until only one player has at least one point remaining, and is declared the winner.

3 Claims, 4 Drawing Sheets

FIGURE 3
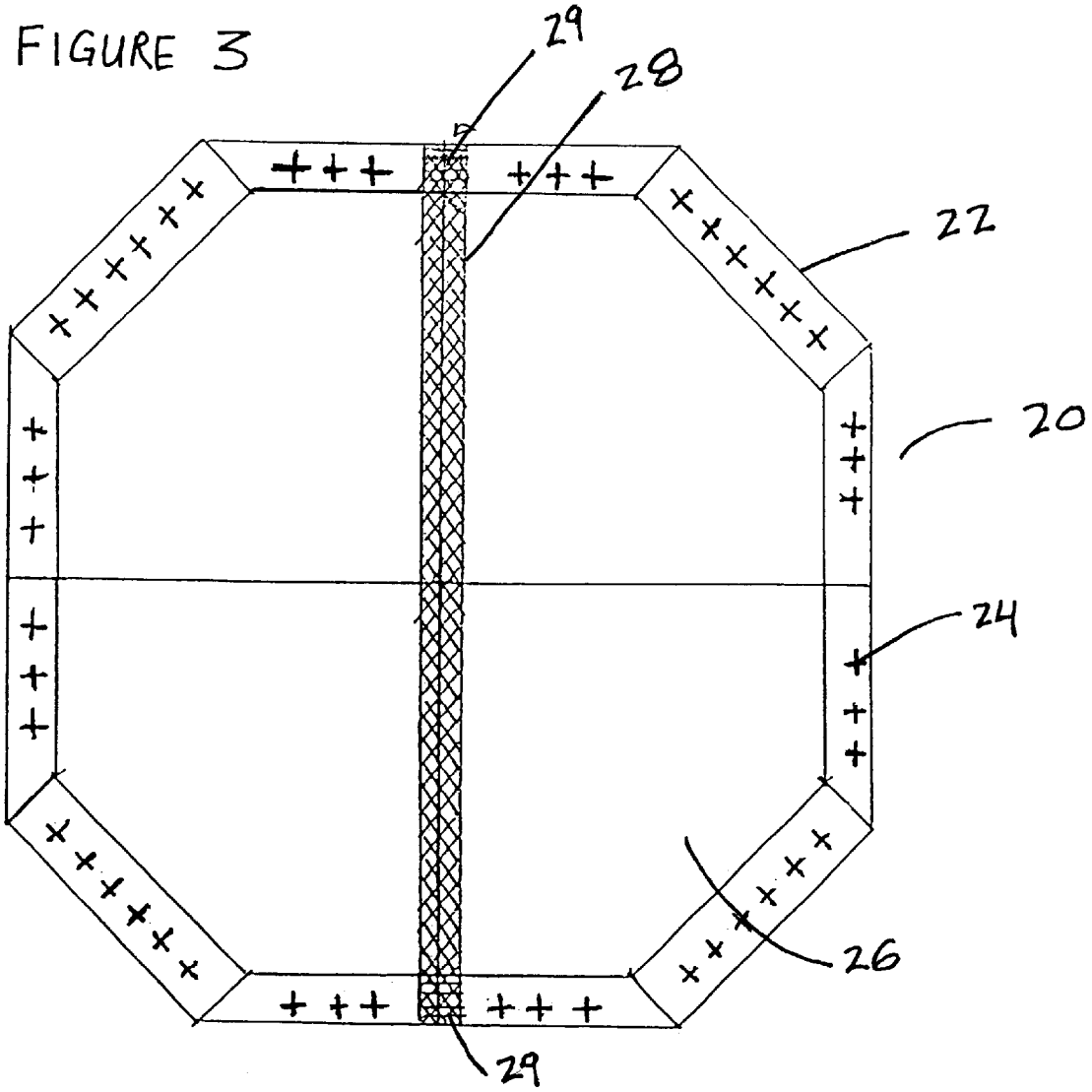
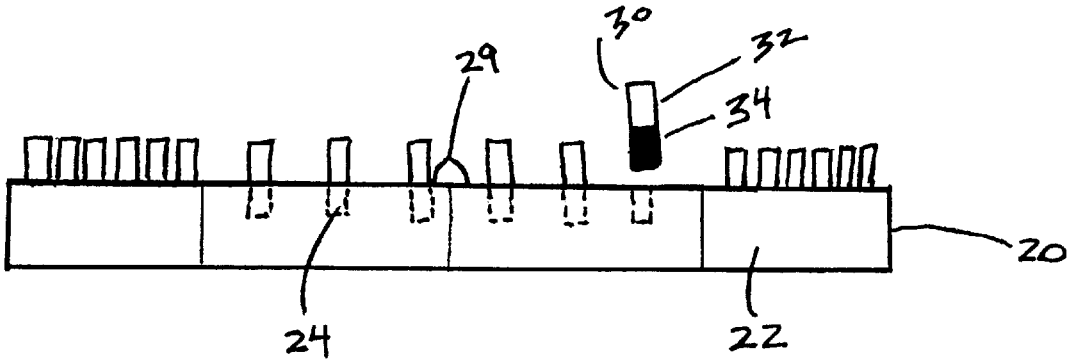
FIGURE 4

METHOD AND APPARATUS FOR PLAYING A DICE GAME

FIELD OF THE INVENTION

This invention is a game for playing dice, in apparatus and method aspects.

BACKGROUND OF THE INVENTION

It is desirable to provide an entertaining game that may be played between two or more players in a private setting, or at a casino with players playing against a dealer. The game should provide entertainment value by blending elements of chance, strategy, and skill. Also, the game should be relatively simple to play and easy to learn, be readily transportable, and should facilitate betting to increase the competitiveness and excitement between the players.

Using dice introduces an element of chance and unpredictability to the game, which adds excitement. However, the game's entertainment value is limited if it is based solely on chance. Pitting one's strategy and skill against other players adds tension and further excitement to the game. To more fully exploit the opportunity to use strategy and skill in a dice game, it is desirable to expand the number of rollable combinations of conventional six-sided dice. The most popular method of determining the ranking of, say, a pair of rolled six-sided dice, is to merely add the value of the upturned faces of the two dice; this gives a maximum of 11 different combinations, i.e. from a two to a twelve. Such a limited number of combinations has a number of drawbacks, the most apparent being the difficulty in determining a winning roll when there are many players participating. U.S. Pat. No. 5,788,239 suggests a method of ranking a pair of dice that gives twenty-one different combinations and uses a system of letters to distinguish the ranking of combinations having the same additive value. While this method of ranking provides an expanded number of rollable combinations, this method is complicated and not easy to learn or memorize.

Provided that there is a suitable method of ranking the rollable combinations of dice, excitement can be added to the game by having players bet against each other and into a collective pot during the course of the game. Further, skill and strategy can be introduced into the game be allowing the players to have some degree of control over the frequency, amount and timing of betting, the number of rolls a player may make for a given turn, etc.

SUMMARY OF THE INVENTION

I call my invented game "Olé". The game of Olé is a dice game played by at least two players using a pair of conventional six-sided dice. All possible combinations of the values of upturned faces of the pair of dice are exhaustively ranked, but not necessarily in conformity with conventional ranking; a preferred ranking is described in detail below. A session of play consists of a number of turns, wherein in each turn, each player rolls the pair of dice. The value of each player's rolled dice is compared with that of each other player's rolled dice in the turn, and a losing player is determined to be the player having rolled the worst-ranked combination. In my preferred system of scoring, the losing player then deducts a point from a collection of points assigned to him at the start of the game. Turns are played until only one player has at least one point remaining, and is declared the winner. It is apparent that instead of the foregoing, alternative scoring could be arranged; my invention is not limited by the specific scoring system devised but admits of alternatives.

In my preferred scoring system as set forth above, if a player runs out of his initially allocated points, he may purchase additional points up to a number of points possessed by the player having the lowest number of points greater than zero at the time the purchase is being made. In any session of play, each player is allowed one opportunity to purchase points. When a player reaches a zero point total after he has used his point purchase opportunity, the player may be required to retire from the session, or in any event loses the capability to win the session.

The game is preferably played accompanied by betting. The game may be played as a board game by a number of players using a playing board, score-tracking means, dice, or alternatively, the game may be played as a casino game with a number of players playing against a dealer. Note that many means are known to provide six value options of each of two constituent variable-value elements; while dice are described as a preferred example, any such means may be selected for use. Further, there is no inherent reason to limit the number of value options to six, nor the number of constituent variable-value elements to two. My invention admits of variance in the foregoing respects and in other respects that will readily occur to those skilled in game design.

BRIEF DESCRIPTION OF THE DRAWINGS

FIG. 3 is a plan view of the playing board illustrated in FIG. 1.

FIG. 4 is a side view of the playing board illustrated in FIG. 3 and of the associated scoring pegs.

DETAILED DESCRIPTION

Figure 1:
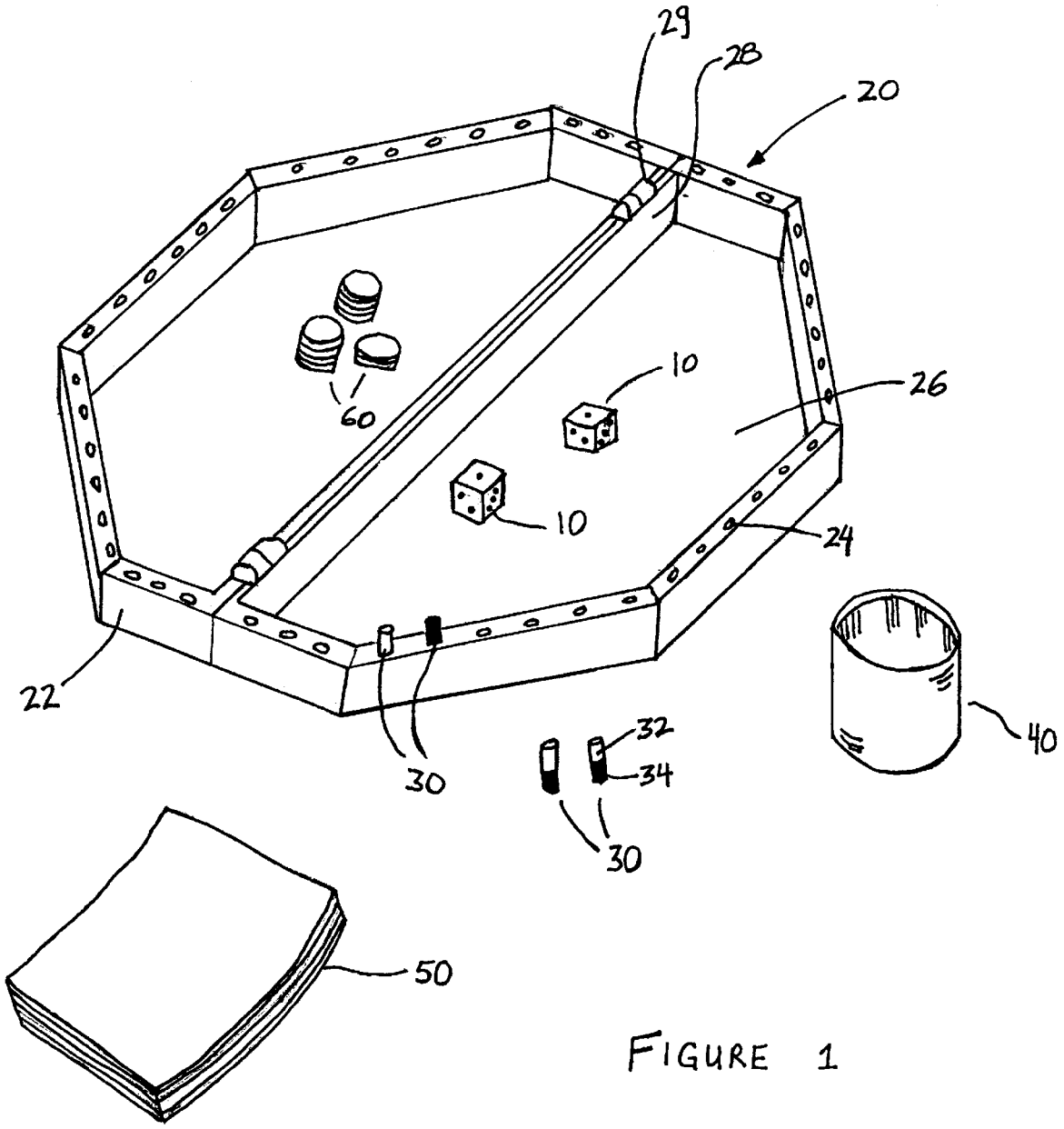
FIG. 1 is an isometric view of game pieces of Olé according to a first embodiment of the invention, including a game playing board, two dice, scoring pegs, scoring chips, a tie-breaker cup, and a score-keeping pad.

According to a first embodiment of the invention and referring to FIG. 1, the game of Olé is played with a conventional pair of six-sided dice 10, a playing board 20, a plurality of scoring pegs 30, and a tie breaker cup 40. The game may optionally include a score-keeping pad 50, and scoring chips 60.

Olé is a type of dice game involving at least two players who play against each other. Each player is provided with a selected number of points at the beginning of the game. The game is played in a number of turns; in each turn, each player rolls the pair of dice, the values of the rolled dice are compared, and a losing player is determined to be the player who rolled the lowest-ranked combination. The losing player deducts one point from his collection of points, and play continues until there is only one player with any points, who is then declared to be the winner. Those players who reach zero points is granted a single opportunity to purchase points; that is, only one such opportunity per session of play is permitted. A player who reaches zero and has either exhausted his opportunity to purchase points or does not care to purchase points is required to retire from the session.

Figure 2:
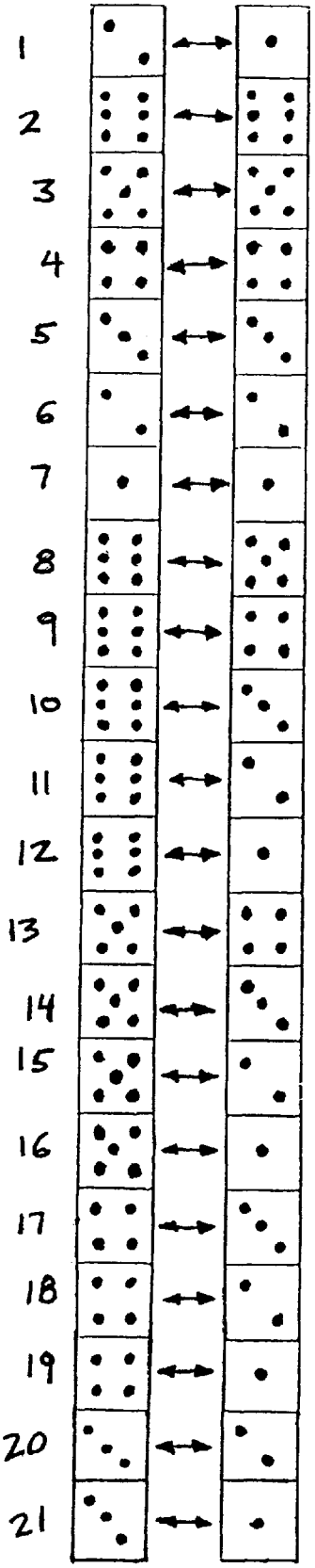
FIG. 2 is a schematic illustration of a preferred ranking of twenty-one possible combinations that can be rolled for a pair of dice, from best to worst.

To assess the value of each rolled pair of dice 10, every possible rollable combination is exhaustively ranked. Referring to FIG. 2, there are a total of twenty-one such possible combinations. My preferred combinations, from best to worst, are:

a two and one, six and six, five and five, four and four, three and three, two and two, one and one, six and five, six and four, six and three, six and two, six and one, five and four, five and three, five and two, five and one, four and three, four and two, four and one, three and two, three and one.

The combination of two and one is referred to as "olé"; if this combination is rolled in a turn, the losing player of the turn must in my preferred method of scoring deduct two points instead of the customary single point from his point total. If more than one player rolls olé in a turn, the losing player must deduct two points for each olé rolled in the turn.

Referring to FIG. 3, the game board 20 has eight walls 22. The top surface of each wall 22 has a plurality of peg openings 24 for receiving pegs 30. Each wall 22 serves as a station for each player who tracks his score with the number of pegs 30 in his station. The octagonal game board 20 can accommodate up to eight players in this embodiment; an alternative board may have a different number of stations to accommodate a different number of players depending on the preference of the designer. The walls 22 surround an octagonal shaped flat playing surface 26. Dice 10 are rolled onto the playing surface 26, and there may be markings on the playing surface 26 to indicate an area for placing cash or betting chips 60 bet by each player.

Optionally, a foldable version of the game board 20 may be constructed, by separating the game board 20 into two equal portions and using a partition wall 28 and hinges 29 to enable the game board 20 to be foldable into a more compact and transportable form.

At the beginning of the game, each player is assigned a predetermined number of scoring pegs 30. In this embodiment, there are six peg openings 24 to accommodate up to six scoring pegs 30; however, a different number of peg openings 24 may be selected depending on the preference of the game designer. The use of pegs serves as a means for tracking each player's score during the course of the game. Referring to FIG. 4, each scoring peg 30 has a first coloured portion ("start colour") 32 and a second coloured portion ("purchased peg colour") 34. At the start of the game, each player places his pegs 30 with the start colour portion 32 protruding out of the respective peg opening 24 of his station. If the game is played as a betting game, each player may bet a pre-determined set amount at the beginning of the game. Or, a value may be assigned to each peg 30, and the number of start pegs each player gets at the start of the game may be determined by the value of the bet placed by the player at the start of the game. Of course, optional betting may be permitted at each turn, or side bets may be made, as often happens in the course of play of other dice games.

The roll order of the first turn may be determined by having each player roll a single die 10. The player with the highest roll starts the first turn in the game session, and roll order is then determined in preferably a clockwise (or optionally, counter-clockwise) direction around the playing board 26, as may be selected.

In each turn, the starting player rolls the pair of dice 10. Optionally, if the player is not satisfied with the value he has just rolled, he may roll the dice 10 again, up to (say) a maximum total of three rolls, and must accept the value of the last rolled pair of dice 10. The number of rolls selected by the first player sets the maximum number of rolls allowed by the other players. After every player has completed his selected number of rolls, the last roll of each player is compared and a losing player is determined. If no olé (two and a one) is rolled, the losing player removes one peg 30 from his collection. If one or more of the other players rolls an olé, the losing player must remove two pegs 30 for each olé that has been rolled in that turn.

Optionally, the losing player of the turn then becomes the starting player for the next turn. This option tends to equalize the play, since the losing player of the preceding turn may have up to three chances to obtain a high-value roll in the current turn. Turns are played until only one player is left with any pegs 30, and, subject to the other players having waived or exercised their purchase option described below, is then declared to be the winner.

Should a player run out of pegs so that his score reaches zero, then under my preferred method of play, he has one opportunity to purchase additional pegs 30. If he does not take this opportunity, he in my preferred method of play is required to discontinue playing in the current session. If the player decides to purchase some pegs 30, the purchased pegs 30 are placed into the player's station with the purchased peg colour 34 facing up; this differentiates the purchased pegs from starting pegs and indicates that the player has exercised his single opportunity to purchase pegs 30 and may not make any subsequent purchases in that session. The value of each peg 30 is pre-determined at the start of the game, and if the game is played with betting, the purchase payment, if made to the bank, is added to the pot. The purchasing player may purchase a number of pegs up to the number of start-coloured pegs 30 of the player having at the time of purchase the lowest number greater that zero of such pegs 30. In other words, no purchaser of pegs may improve his playing peg total to a number greater than that of the player who at the time the purchase is made has the lowest number of playing pegs.

In the preferred embodiment, pegs are purchased from the a central bank, and the purchase money is placed into the pot.

If, in a turn, two players roll the same combination of dice 10, and the value of that combination is the lowest value rolled amongst all the players in the turn, the two players play a tie-breaker. The player who rolled the tying dice places the dice 10 in the opaque tie-breaker cup 40 ("first tying player") and rolls the dice under the cup. Then, in my preferred method of play, with the rolled dice still out of sight under the cup, the other player ("second tying player") guesses whether the dice 10 he will roll will be higher or lower than the value of the dice 10 under the tie breaker cup. Then, the second tying player rolls the dice 10. The value of each player's rolled dice 10 is compared, and the winner is determined by whether the second tying player was able to predict the outcome correctly. If both players roll the same value in the tie-breaker, the tie-breaker steps are replayed until a winner is determined. The losing player then removes a peg 30 from his collection.

Should three or more players roll the same value in a turn and the value is the lowest amongst all the rolled values, the players who have rolled the same value play a turn amongst themselves, and the losing player deducts a peg 30 from his collection.

A ranking sheet (not shown) with a table ranking all of the rollable combinations in a manner, like that illustrated in FIG. 2, may be optionally provided as a reference guide to the players.

Figure 5:
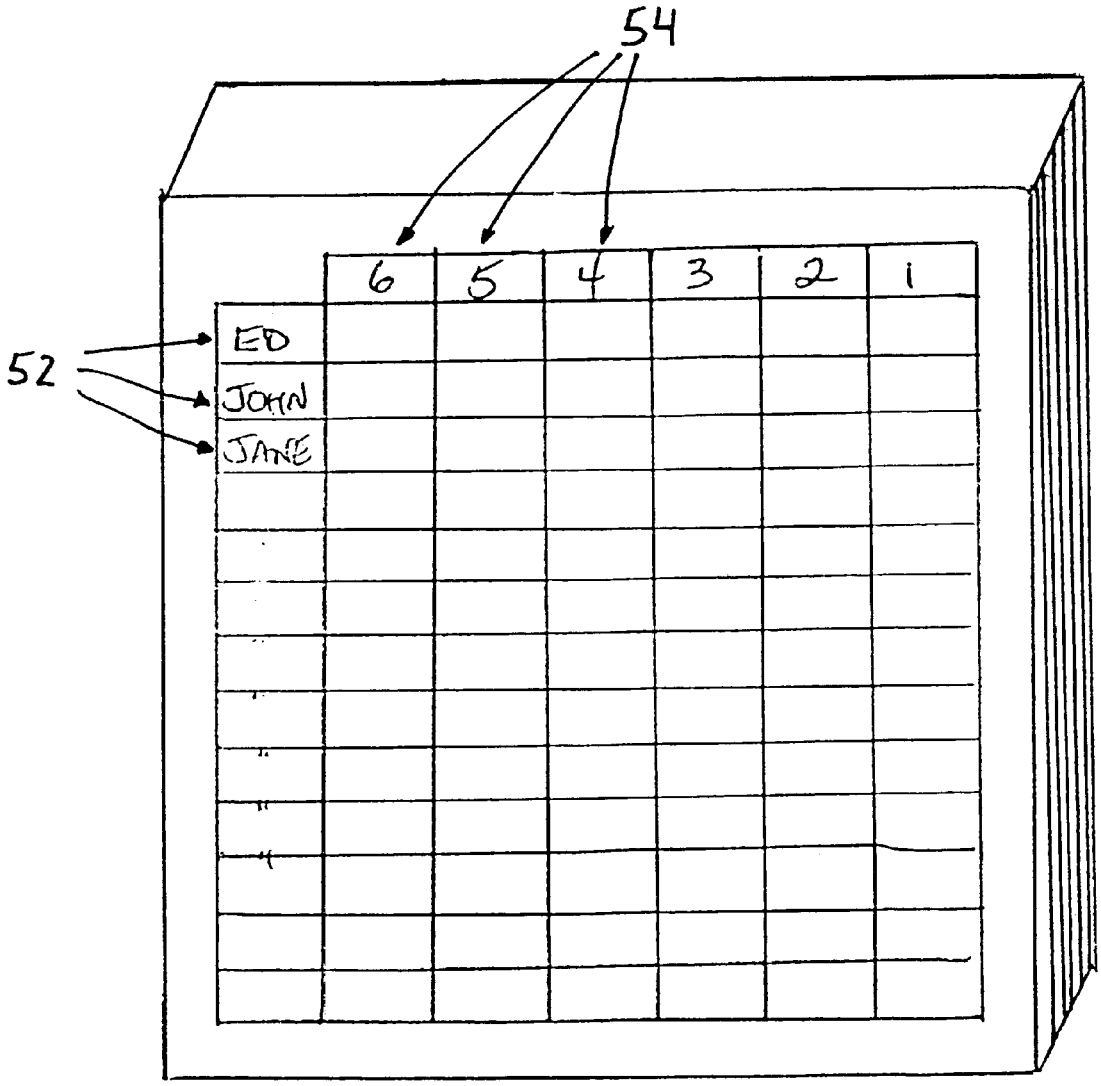
FIG. 5 is a detailed illustration of the score-keeping pad illustrated in FIG. 1.

Referring to FIG. 5 and in a second embodiment of the invention, the game is played with only a pair of conventional six-sided dice 10 and the score-keeping pad 50. The score-keeping pad 50 replaces the use of pegs 30 and the game board 20. The game is played in the same manner as described in the first embodiment, except that scoring is tracked with the score-keeping pad 50 instead of pegs 30. FIG. 5 illustrates a suitable such score-keeping pad 50. The score-keeping pad 50 has a plurality of rows 52, one row for each player, and a plurality of columns 54, one column for each of the points lost by each player during the course of play. In a tie-breaker, a player's hand may be used in place of the tie-breaker cup to cover the tie-breaking roll of the first-tying player out of sight of the second tying player.

Other alternatives and variants of the above-described methods and apparatus suitable for practising the inventions will occur to those skilled in the technology. For example, the game can be played with three or more dice, with the ranking table modified accordingly. Or, each die may have more or fewer than six faces, providing different rollable combinations of upturned faces. Other alternatives consistent with the underlying scheme of the game will occur to those skilled in game design. For example, the game may be played with a minimum of equipment, using only some dice and a score tracking means; for example, the game may be played in a casino, wherein suitable modifications may be made to betting strategies to incorporate betting against the house.

What is claimed is:

1. A method of playing a game comprising the steps of:

(a) exhaustively ranking all possible combinations of upturned faces of two dice, each die having six faces with each face being marked with a dedicated value between and including one and six and wherein the exhaustive ranking of the upturned faces of the pair of dice from best to worst are, two and one, six and six, five and five, four and four, three and three, two and two, one and one, six and five, six and four, six and three, six and two, six and one, five and four, five and three, five and two, five and one, four and three, four and two, four and one, three and two, three and one;

(b) in a turn played between at least two players, (i) rolling the dice by each player, (ii) comparing the rank of each player's rolled pair of dice to determine a losing player, the losing player having rolled the worst-ranked combination, (iii) deducting a point from a number of starting points from the losing player, wherein a player having deducted all his points may purchase additional points of pre-determined value from a central bank, the additional points of a number not exceeding the number of points possessed by another player having the lowest number of points greater than zero at the time the purchase is made; and (c) playing a plurality of turns until only one player has at least one point remaining, and is thereby declared the winner of the game.

2. The method as claimed in claim 1 wherein a player may purchase points only once during a game session.

3. The method as claimed in claim 1 wherein for two players that roll the same combination in a turn and the value of the rolled combination is the lowest of the combinations rolled in the turn, a tie-breaker is played, the tie-breaker comprising the steps of:

(a) a first tying player rolling the dice out of sight of a second tying player;

(b) the second tying player guessing whether the value of his or her roll will be higher or lower than the value of the roll of the first tying player; then (c) the second player rolling the pair of dice; then, (d) comparing the values of the rolled dice of the first and second tying players to determine whether the second tying player's guess is correct and is thereby the winner of the tie-breaker, or is incorrect and is thereby the loser of the tie-breaker; and in the event both players roll the same combination, replaying the tie-breaker; then, (e) deducting a point from the loser of the tie-breaker.

* * * * *